US006554234B2

(12) United States Patent
Holdren

(10) Patent No.: US 6,554,234 B2
(45) Date of Patent: Apr. 29, 2003

(54) SUPPORT FOR A MUSCULARLY CHALLENGED PERSON

(76) Inventor: Howard P. Holdren, R.R. 1, Box 353, Ulster, PA (US) 18850

( * ) Notice: Subject to any disclaimer, the term of this patent is extended or adjusted under 35 U.S.C. 154(b) by 20 days.

(21) Appl. No.: 09/578,791

(22) Filed: May 23, 2000

(65) Prior Publication Data

US 2002/0158172 A1 Oct. 31, 2002

(51) Int. Cl.[7] ..... B43K 29/00

(52) U.S. Cl. ..... 248/118.5; 400/715; 294/25; 601/33; 434/166

(58) Field of Search ..... 248/118.1, 118.3, 248/118.5, 278.1, 279.1, 287.1, 118; 400/715; 434/166; 601/33; 623/65; 294/25; 128/878, 879; 297/411.21, 411.3, 411.35

(56) References Cited

U.S. PATENT DOCUMENTS

| | | | | | |
|---|---|---|---|---|---|
| 481,293 | A | * | 8/1892 | Bailey et al. | 248/118 |
| 2,119,325 | A | * | 5/1938 | Goodhart | 602/16 |
| 3,101,568 | A | * | 8/1963 | Tratt | 248/118 |
| 3,981,526 | A | * | 9/1976 | Lundqvist | 294/25 |
| 4,157,616 | A | * | 6/1979 | Lundqvist | 30/153 |
| 4,259,949 | A | * | 4/1981 | Axelsson | 128/77 |
| 4,784,120 | A | * | 11/1988 | Thomas | 128/77 |
| 4,913,393 | A | * | 4/1990 | Wood | 248/283.1 |
| 4,944,766 | A | * | 7/1990 | Williams | 401/6 |
| 4,993,766 | A | * | 2/1991 | Sutherland | 294/19.1 |
| 4,996,977 | A | * | 3/1991 | Tiedeken | 128/77 |
| 5,058,840 | A | | 10/1991 | Moss et al. | 248/118.5 |
| 5,074,501 | A | | 12/1991 | Holtta | 248/118.3 |
| 5,228,610 | A | * | 7/1993 | Spence | 224/267 |
| 5,571,274 | A | * | 11/1996 | Holstensson | 297/411.38 |
| 5,651,586 | A | * | 7/1997 | Groth | 297/411.37 |
| 5,716,087 | A | * | 2/1998 | Backich et al. | 294/55 |
| 5,743,499 | A | * | 4/1998 | Wang | 248/118 |
| 5,753,840 | A | * | 5/1998 | Saboia De Albuquerque | 84/453 |
| 5,924,752 | A | * | 7/1999 | Moody | 294/25 |
| 6,062,754 | A | * | 5/2000 | Holdren | 401/48 |
| 6,082,795 | A | * | 7/2000 | Fornelli | 294/58 |

FOREIGN PATENT DOCUMENTS

| | | | | |
|---|---|---|---|---|
| DE | 57540 B1 | * | 1/1891 | 248/118.5 |

* cited by examiner

*Primary Examiner*—Ramon O. Ramirez
*Assistant Examiner*—Jon Szumny
(74) *Attorney, Agent, or Firm*—Salzman & Levy

(57) ABSTRACT

A device for assisting muscularly disadvantaged persons and hypotonic individuals to perform a multiplicity of tasks. The device includes a hand grip and wrist support that is supported along two dimensions of travel by frictionless support surfaces, such that the task is performed with a gliding or fluid movement.

11 Claims, 5 Drawing Sheets

SUPPORT FOR A MUSCULARLY CHALLENGED PERSON

FIELD OF THE INVENTION

The present invention relates to supports for muscularly challenged individuals and, more particularly, to a hand grip and wrist brace mounted upon a glide support for easing the movements of individuals with hypotonia, and which allows the performance of a multiplicity of tasks with fluid and graceful motion.

BACKGROUND OF THE INVENTION

Individuals with muscular dystrophy and other disabling muscular ailments suffer from a condition known as hypotonia, wherein the muscles lack tone and strength. These individuals have difficulty doing the simple tasks that others take for granted, such as writing, eating, tying a shoelace, etc.

Many devices have been invented for assisting the muscularly disadvantaged individual, as illustrated in U.S. Pat. No. 5,074,501, issued to Seppo Holtta on Dec. 24, 1991, for DEVICE FOR SUPPORTING OF THE HAND. The device of this patent comprises a series of links that pivot and rotate to provide a flexible motion for a hand of a hypotonic individual.

Another such device comprises an arm rest that is usable with a mouse pad or keyboard, as shown in U.S. Pat. No. 5,058,840, issued on Oct. 22, 1991, to Moss et al, entitled APPARATUS AND METHOD FOR REDUCING REPETITIVE OR MAINTAINED STRESS INJURIES. The apparatus comprises an assembly that utilizes a forearm cradle and a detachable, linear slide which is pivotal and simultaneously moveable in a straight line. The cradle has springs for counteracting against the weight of the arm resting thereupon. The arm is capable of moving up and down the keyboard, or mouse pad, in a linear direction.

One of the serious drawbacks of many of the devices used to aid these handicapped people, is an inability to provide support for doing a multiplicity of tasks. Also, many of these apparatuses are overly complex, and do not provide fluid motion. The individual is often reduced to making discoordinate motions and "herky jerky" movements. Although the task may be more easily accomplished with use of these aids, the self-esteem of the user may be severely impaired with their use.

The present invention features a support device for a hypotonic person that allows the individual to perform a multiplicity of tasks with a fluid motion. The apparatus comprises an extension to which a tool or instrument for performing a task can be attached. A wrist and forearm support is attached to the top glide, and is itself supported upon a first glide member. The first glide member is moveable along an X-axis. The first glide member is itself supported upon a second glide member that is moveably supported along a Y-axis. The apparatus allows the individual to perform a given task fluidly, and move in a multi-dimensional direction with graceful ease. The fluid motion not only allows the individual to perform the task at hand, but also influences and encourages the individual to execute the job with alacrity and dispatch.

SUMMARY OF THE INVENTION

In accordance with the present invention, there is provided an apparatus having fluid motion for assisting muscularly disadvantaged individuals to perform a multiplicity of tasks. The apparatus comprises an extension to which a tool or instrument for performing a task can be attached. A wrist and forearm support is attached to the top glide, and is itself supported upon a first glide member. The first glide member is moveable along a first axis. The first glide member is itself supported upon a second glide member that is moveably supported along a second axis. The apparatus allows the individual to perform a given task fluidly, and move in a multi-dimensional direction with graceful ease. The fluid motion not only allows the individual to perform the task at hand, but also influences and encourages the individual to execute the job with alacrity and dispatch.

It is an object of the invention to provide an improved device for a muscularly challenged individual.

It is an object of this invention to provide a support for a hypotonic individual that assists that person to a multiplicity of tasks with fluid ease.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a device for assisting muscularly disadvantaged and hypotonic individuals to perform a multiplicity of tasks. The device comprises a hand grip and wrist support that is supported along two dimensions of travel by frictionless support surfaces, such that the task is performed with a gliding, or fluid movement.

Figure 1A:
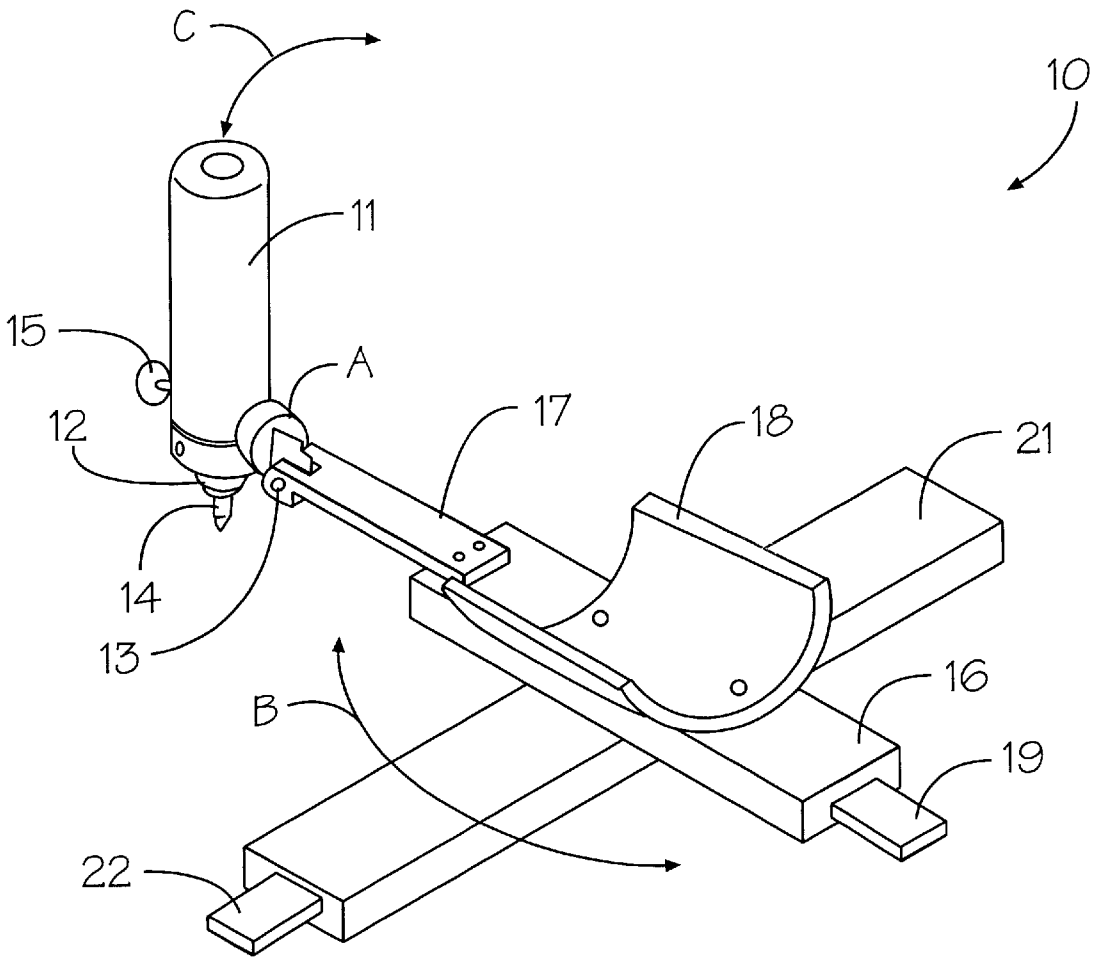
FIG. 1*a* illustrates a perspective schematic view of the apparatus of this invention, including a writing implement held by the tool.

Now referring to FIG. 1*a*, the apparatus 10 for assisting muscularly challenged individuals is shown in schematic perspective. The device comprises a hand grip 11 having a chuck 12 disposed at its distal end. The chuck 12 is adapted to receive a tool or instrument 14 for performing a task, such as writing or drawing. The tool 14 can be secured in the chuck 12 by means of a set screw 15. The chuck 12 can also be a keyless chuck.

Figure 2:
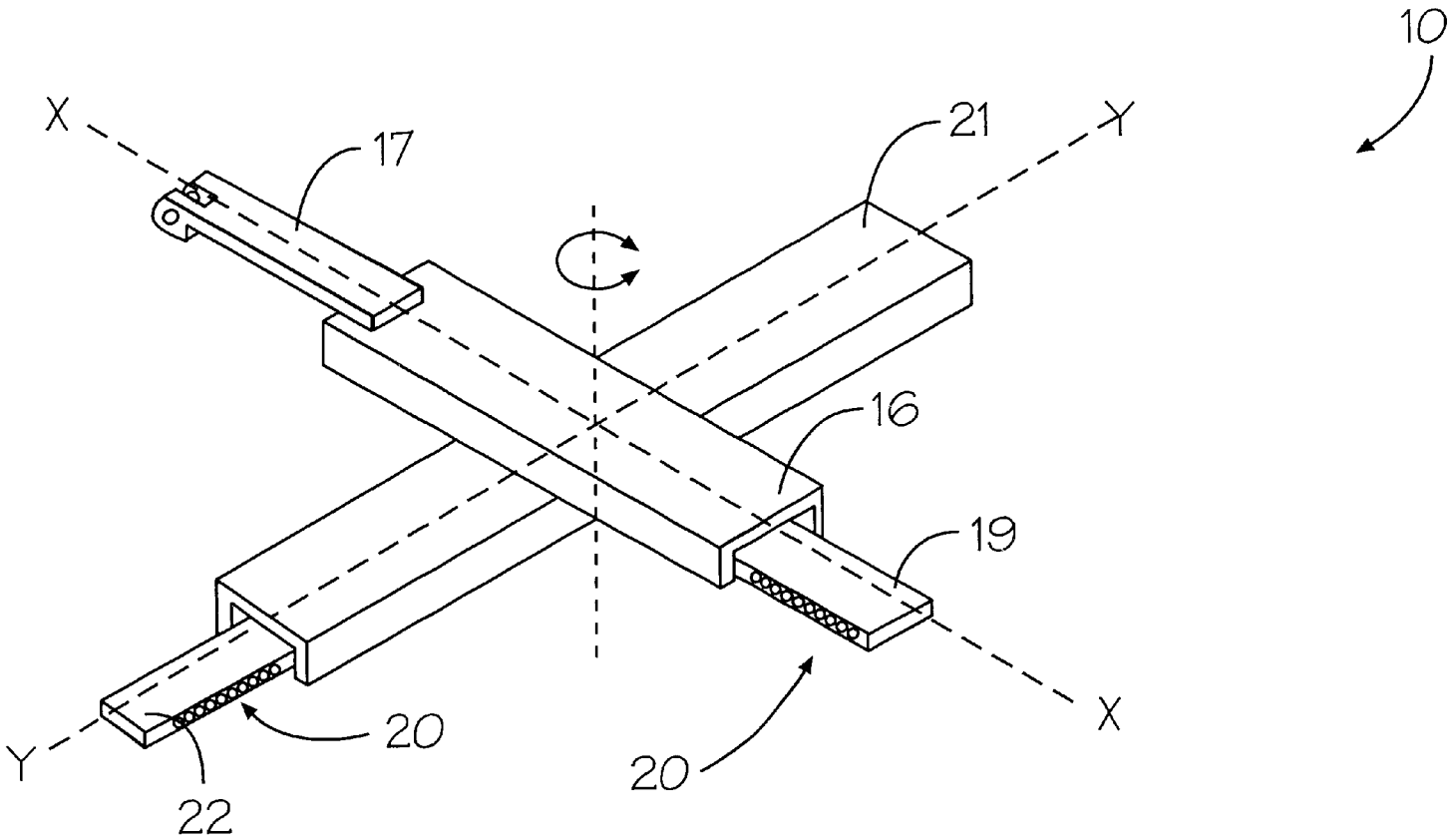
FIG. 2 depicts a perspective schematic view of a first ball race supporting the wrist and forearm support for the apparatus illustrated in FIG. 1.

The hand grip 11 with its fixtured instrument 14 is pivotally attached to a first wrist and forearm support platform 16, via an extension 17, about pivot "A" and pivot pin 13, providing vertical movement of hand grip 11 (arrow "C") and tool 14 to move the pencil or pen off of the writing medium. The support platform 16 comprises a wrist and forearm cuff 18, which may consist of fabric, foam or other compliant material, and provides a means by which the arm of the individual (not shown) can be supported upon the first support platform 16. The cuff 18 can be secured about the wrist and forearm of the individual by means of Velcro fasteners or other fabric securing means, not shown. The first support platform 16 is supported upon a first under support member 19 having a frictionless surface coated with Teflon, or containing a ball-bearing race 20, as shown in FIG. 2.

The ball-bearing race 20 allows the wrist and forearm supporting platform 16 to glide fluidly along an X-axis, upon the first under supporting member 19. The under supporting member 19 is rotatively attached (arrow "B") to a second platform 21, disposed transverse of platform 19, as illustrated. The platform 21 is fluidly glide supported upon a second under support member 22 along a Y-axis. The second support platform 21 comprises a frictionless surface of Teflon or a ball-bearing race 23, as illustrated. Platform 21 need not be linearly configured. For example, when the shape of platform 21 and second under support member 22 are curved, not shown, a radial motion can be obtained.

Figure 3:
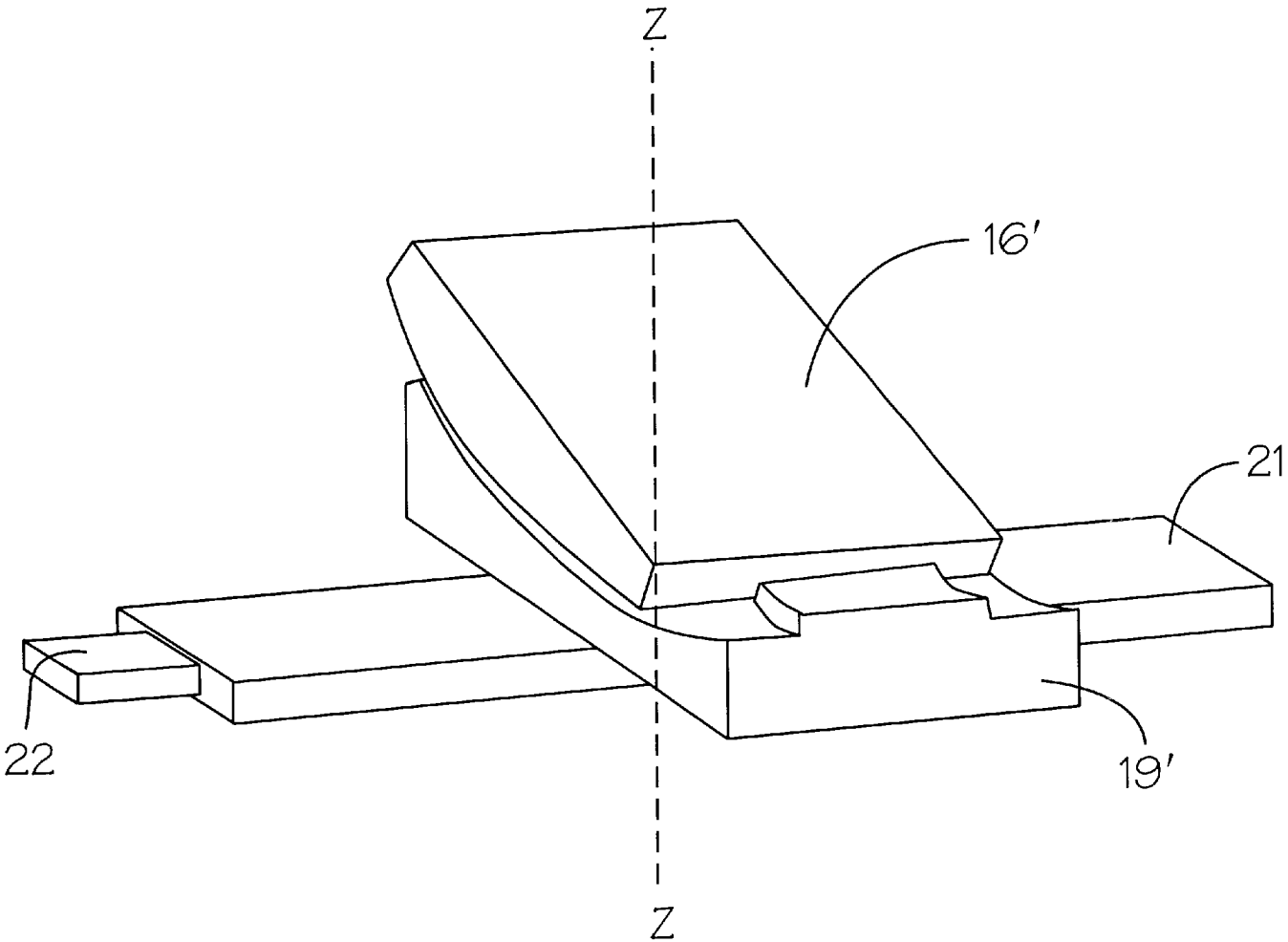
FIG. 3 is a perspective view of the device in accordance with the invention and including a curved support platform for vertical movement.

Also, the first support platform can be removed and replaced, as shown in FIG. 3, with a curved support platform 16', to provide means for movement in the z-direction. This is advantageous for working on slanted work surfaces such as are adapted for communication devices, not shown. Curved support platform 16' is supported upon an under support member 19' which, in turn, is rotatively attached to second platform 21.

Figure 1B:
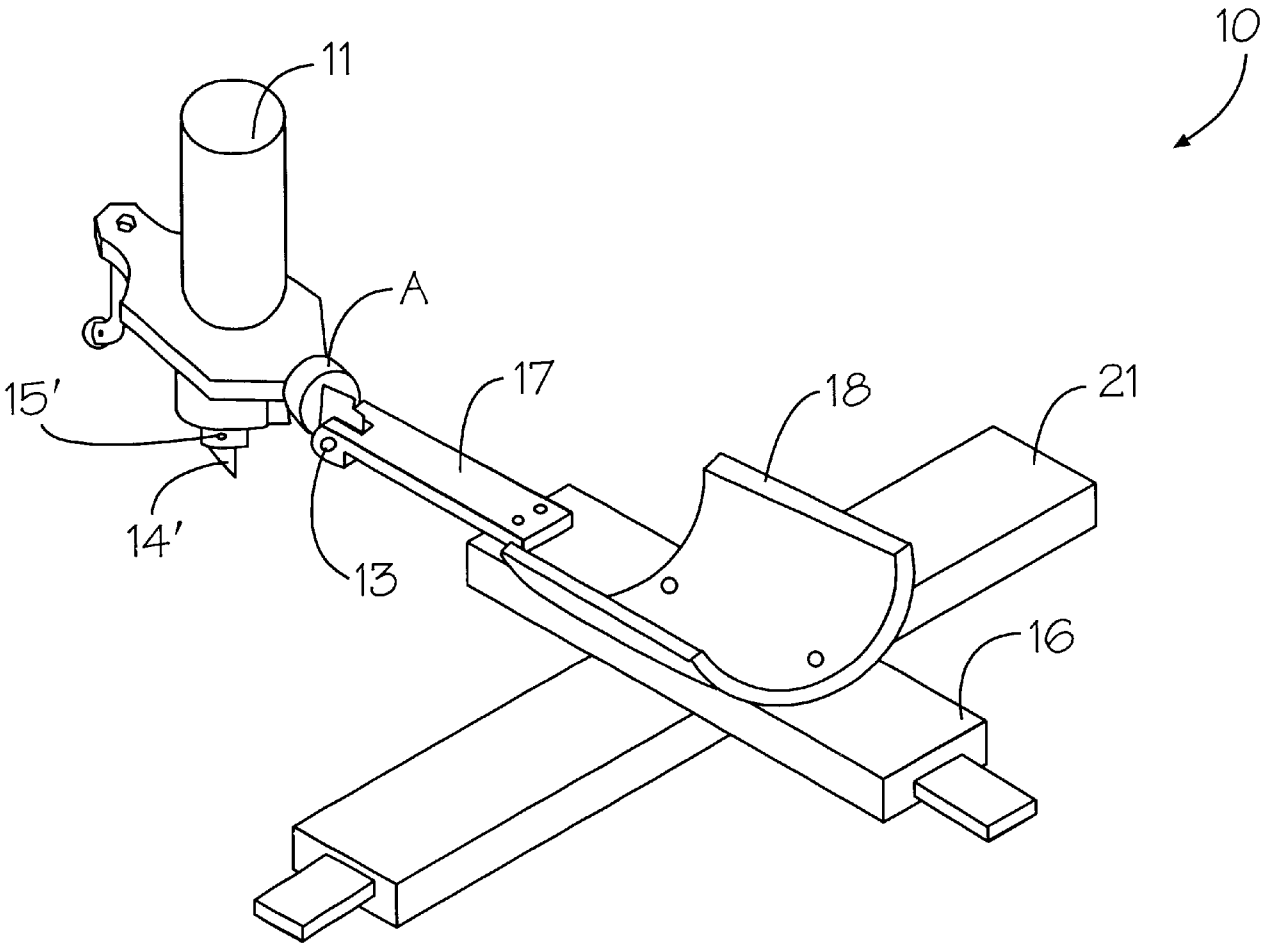
FIG. 1*b* illustrates a perspective schematic view of another embodiment of the apparatus, including a cutting blade held by the tool.

Referring now to FIG. 1*b*, an alternate embodiment of the apparatus 10 is shown in schematic perspective. Hand grip 11 has a chuck 12 disposed at its distal end. The chuck 12 is adapted to receive a tool or instrument 14' for performing a task, such as cutting. The tool 14' can be secured in the chuck 12 by means of a set screw 15'.

It should be understood that, for certain activities, such as writing, an individual may not require the hand grip and instrument structure. In such cases, the inventive device can be used without hand grip 11, tool 14 and extension 17 to provide forearm support alone.

Figure 4:
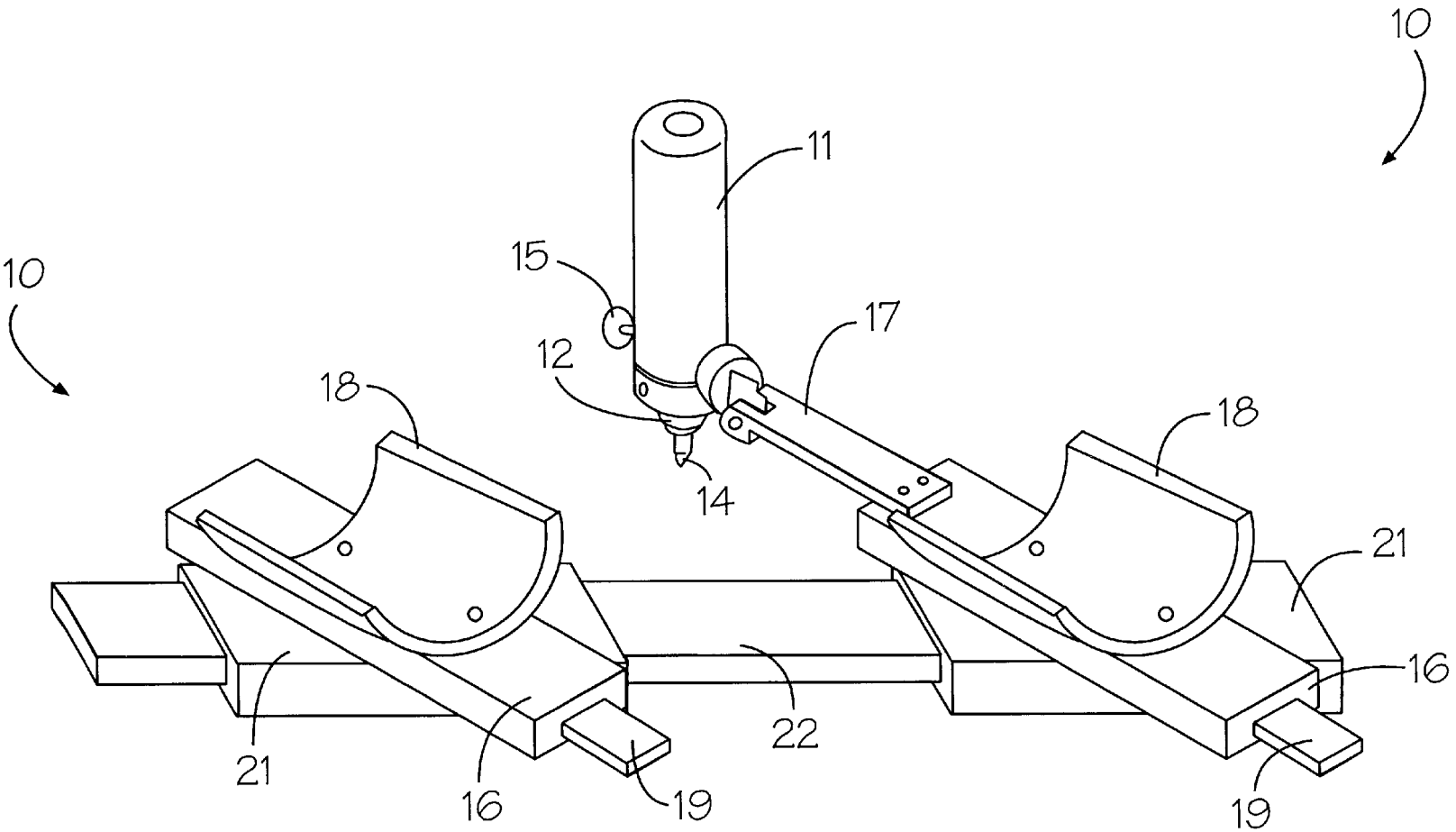
FIG. 4 is a perspective view of two units cooperating with each other along a common support.

Referring now to FIG. 4, there is shown a perspective view of two devices 10 connected to each other along common, under support platform 22. The devices 10 can be operated independently, one per user's arm. This system is advantageous for moving paper or other medium with one hand or arm, while writing, coloring or cutting with the other hand or arm.

The individual who is assisted by the device 10 is able to move the tool or instrument 14 or 14' with two dimensional ease by reason of the gliding motions provided by the transverse ball-bearing races 20 and 23, respectively. The tool 14 or 14' can also be tilted or moved upwardly or downwardly about pivot "A", thus providing a great latitude, while the glide surfaces provide motion versatility and range. In fact, there is no need to grasp the hand grip 11, which can be advantageous for users who are missing fingers.

Easing the movements and motion of the hypotonic and muscularly disadvantaged individual is essential in assisting him or her with a means to perform tasks that are often taken for granted by other individuals. In addition, the fluid and gliding motion by which the assisted individual can perform these tasks provides a boost in the self-esteem of that individual.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus facilitating use of a tool by a muscularly disadvantage individual having a hypotonic muscular condition, comprising:

a) a first substantially rectangular, elongated supporting member having a major axis and a substantially flat bottom surface adapted for direct, selective placement on aplanar surface, said first elongated supporting member having a support platform slidably attached thereto by first substantially friction free engagement means and movable only linearly along a first axis substantially rectangular first elongated supporting member;

b) a second elongated supporting member having a major axis and pivotally attached to and supported by said supporting platform, said second elongated supporting member having a forearm support platform slidably attached thereto by second substantially friction free engagement means and movable along a second axis substantially parallel to said major axis of said second elongated supporting member;

c) a cuff attached to said forearm support platform; and d) an extension member attached to a distal end of said forearm support platform and including a hand grip having means for attaching a tool or instrument adapted for performing a predetermined task;

whereby said first and second substantially friction free engagement means of said first elongated supporting member and said second elongated supporting member allow substantially friction free movement of said forearm support platform, and whereby a muscularly disadvantaged individual can readily move a wrist and forearm supported by said forearm support platform and said cuff along said first axis and said second axis, thereby easily positioning said tool or instrument to perform said task.

2. The apparatus facilitating use of a tool by a muscularly disadvantaged individual having a hypotonic muscular condition as recited in claim 1, wherein at least one of said first and second substantially friction free engagement means comprise a ball-bearing race.

3. The apparatus facilitating use of a tool by a muscularly disadvantaged individual having a hypotonic muscular condition as recited in claim 2, wherein said first and second elongated supporting members are disposed in substantially parallel planes.

4. The apparatus facilitating use of a tool by a muscularly disadvantaged individual having a hypotonic muscular condition as recited in claim 2, wherein said first axis and said second axis are asipted to lie substantially parallel to a planar surface upon which said first elongated supporting member is placed, and said forearm support platform is movable in a direction substantially perpendicular to at least one of said first and second axes.

5. The apparatus facilitating use of a tool by a muscularly disadvantaged individual having a hypotonic muscular condition as recited in claim 2, wherein said means for attaching a tool or instrument to said hand grip comprises a chuck.

6. The apparatus facilitating use of a tool by a muscularly disadvantaged individual having a hypotonic muscular condition as recited in claim 5, wherein said chuck is pivotally attached to said extension member and is free to rotate around an axis perpendicular to said major axis of said forearm support platform and parallel to an upper surface thereof.

7. An apparatus for use on a planar surface and having fluid motion for assisting muscularly disadvantaged individuals to perform a task, comprising:

a) an elongated wrist and forearm support member comprising tool attachment means disposed at a distal end thereof;

b) an elongated support member adapted for disposition on a planar surface for supporting said elongated wrist and forearm support member; and c) a first glide member operatively connected to said wrist and forearm support member and allowing only linear motion along a first axis; and d) a second glide member pivotally attached to said first glide member and operatively attached to said elongated support member, said glide members allowing only linear motion along a second axis;

whereby said muscularly disadvantaged individual can perform a task utilizing a tool or instrument disposed in said tool attachment means by moving said tool or instrument means with fluid ease in multi-dimensional directions.

8. The apparatus for use on a planar surface and having fluid motion for assisting muscularly disadvantaged individuals to perform a task, as recited in claim 7, wherein each of said pair of glide members comprises a substantially frictionless surface for fluidly supporting said wrist and forearm support member.

9. The apparatus for use on a planar surface and having fluid motion for assisting muscularly disadvantaged individuals to perform a task, as recited in claim 8, wherein each of said pair of glide members comprises a ball-bearing race for fluidly supporting said wrist and forearm support member.

10. The apparatus for use on a planar surface and having fluid motion for assisting muscularly disadvantaged individuals to perform a task, as recited in claim 9, wherein said wrist and forearm support member further comprises a cuff.

11. The apparatus for use on a planar surface and having fluid motion for assisting muscularly disadvantaged individuals to perform a task, as recited in claim 7, wherein said wrist and forearm support member is substantially vertically oriented.

* * * * *